US012064040B2

(12) United States Patent
Becker

(10) Patent No.: US 12,064,040 B2
(45) Date of Patent: Aug. 20, 2024

(54) MEDICATION CONTAINER DISPENSER

(71) Applicant: Gerhart Cullen Becker, Haines City, FL (US)

(72) Inventor: Gerhart Cullen Becker, Haines City, FL (US)

( * ) Notice: Subject to any disclaimer, the term of this patent is extended or adjusted under 35 U.S.C. 154(b) by 36 days.

(21) Appl. No.: 17/455,348

(22) Filed: Nov. 17, 2021

(65) Prior Publication Data

US 2022/0151401 A1 May 19, 2022

Related U.S. Application Data

(60) Provisional application No. 63/114,644, filed on Nov. 17, 2020.

(51) Int. Cl.

| | |
|---|---|
| ***A47F 1/08*** | (2006.01) |
| ***A47F 5/08*** | (2006.01) |
| ***B65D 83/04*** | (2006.01) |

(52) U.S. Cl.

CPC ..... *A47F 1/082* (2013.01); *A47F 5/08* (2013.01); *B65D 83/0409* (2013.01); *B65D 2583/0445* (2013.01); *B65D 2583/0477* (2013.01)

(58) Field of Classification Search

CPC ... A47F 1/082; A47F 5/08; B65D 2583/0445; B65D 83/0409; B65D 2583/0477

USPC ..... 221/22; 206/225

See application file for complete search history.

(56) References Cited

U.S. PATENT DOCUMENTS 744,642 A * 11/1903 Stone ..... B43K 5/04 401/154
1,956,642 A * 5/1934 Einson ..... B65D 5/16 206/45.25
3,121,511 A * 2/1964 Whitehead ..... B65D 83/00 206/508
3,580,472 A * 5/1971 Stawski ..... B65D 83/00 222/173
3,830,411 A * 8/1974 Krechmar ..... B65D 83/0418 222/363
3,877,572 A * 4/1975 Wiener, Jr. ..... A47G 1/06 206/226
3,991,908 A 11/1976 Thomas et al.
4,053,242 A * 10/1977 Mast, Jr. ..... A61F 15/001 401/6
4,101,053 A * 7/1978 Mast, Jr. ..... A45D 33/00 15/244.1
4,253,842 A * 3/1981 Ehrlich ..... C11D 17/041 510/296
4,432,451 A * 2/1984 Hooser ..... A47K 10/22 242/597.8
4,491,242 A * 1/1985 Trinidad ..... A47K 10/426 221/312 R (Continued)

*Primary Examiner* — Rakesh Kumar
(74) *Attorney, Agent, or Firm* — Dunlap Bennett & Ludwig, PLLC; Anna L. Kinney

(57) ABSTRACT

A pharmaceutical dispenser includes a substantially cylindrical dispenser body including a curved sidewall with a flat longitudinal surface, a base perpendicular to the flat longitudinal surface at a first end, an orifice at a second end, opposite the base, and a side portal spaced from the base; and a cap that can couple to the first end and to the second end. The curved sidewall has a side portal having a perimeter in an arced "T" shape with rounded edges. The dispenser accommodates multiple capped cylindrical pharmaceutical containers.

5 Claims, 4 Drawing Sheets

(56) References Cited

U.S. PATENT DOCUMENTS 4,574,981 A * 3/1986 Jewett ..... A47F 1/08 221/311
4,735,313 A * 4/1988 Schoenberg ..... B65D 71/0003 206/427
D301,643 S * 6/1989 Bakic ..... D28/85
4,978,004 A * 12/1990 Silverstein ..... B65D 43/0229 206/391
5,042,687 A * 8/1991 McKinley ..... A47G 29/00 221/45
5,368,191 A * 11/1994 Johnson ..... B65D 83/08 312/42
5,425,474 A * 6/1995 Dalea ..... B65D 5/725 206/499
5,511,691 A * 4/1996 West, Jr. ..... A47F 1/08 221/45
5,657,198 A * 8/1997 Flener ..... H05F 1/00 361/220
D391,681 S * 3/1998 Huang ..... D28/85
6,237,804 B1 5/2001 Peery et al.
6,267,265 B1 7/2001 Issa
6,279,776 B1 * 8/2001 Finkletaub ..... A63F 11/0002 221/281
D456,952 S * 5/2002 Sakurai ..... D28/76
6,854,596 B1 * 2/2005 Wiese ..... A47K 10/22 206/394
D529,819 S * 10/2006 Jackson ..... D9/733
D576,824 S * 9/2008 Eksrom ..... D6/515
7,427,275 B2 9/2008 DeRuntz et al.
7,543,718 B2 6/2009 Simon
7,695,454 B2 4/2010 Barron et al.
7,958,994 B2 * 6/2011 Weinmann ..... B65F 1/062 221/102
8,561,837 B2 * 10/2013 Giammanco ..... A47K 10/46 221/102
9,120,612 B2 * 9/2015 Fath ..... B65D 83/02
9,283,128 B2 * 3/2016 Ulrich ..... B65D 83/0847
9,572,730 B2 * 2/2017 Young ..... B65F 1/1646
9,907,437 B2 * 3/2018 Smith ..... A47J 47/16
10,080,470 B2 * 9/2018 Krengel ..... A47K 10/46
10,457,472 B2 10/2019 Sanders
10,479,588 B2 11/2019 Sanders
10,646,078 B1 * 5/2020 Richard ..... B65D 43/163
10,675,217 B2 6/2020 Hesse
10,683,160 B2 6/2020 Petit
10,787,289 B1 * 9/2020 Bellamah ..... B31B 50/0042
10,792,224 B2 10/2020 Hancock et al.
11,084,647 B2 * 8/2021 Gadd ..... B65D 83/0427
2002/0031588 A1 * 3/2002 Eugster ..... A47F 1/085 99/298
2004/0134928 A1 * 7/2004 Wagner ..... B65D 83/0823 221/303
2005/0199633 A1 * 9/2005 Stanley ..... B65F 1/062 220/495.07
2007/0007301 A1 1/2007 Kaplan et al.
2007/0280773 A1 12/2007 Warren
2012/0018503 A1 * 1/2012 Walling ..... B65D 5/725 229/122.1
2012/0325840 A1 * 12/2012 Restaino ..... B65D 83/0858 221/282
2012/0325841 A1 * 12/2012 Restaino ..... B65D 83/0864 493/162
2014/0319205 A1 * 10/2014 Schultz ..... B65D 5/0245 229/122.1
2016/0184187 A1 * 6/2016 Brown ..... A61J 19/00 4/267
2016/0213202 A1 * 7/2016 Akinpade ..... A47K 5/08
2018/0369070 A1 12/2018 Gielen et al.
2020/0390656 A1 12/2020 Aertker et al.
2021/0063251 A1 * 3/2021 Gleadhill ..... G01K 11/12
2022/0151401 A1 * 5/2022 Becker ..... B65D 83/0409

* cited by examiner

MEDICATION CONTAINER DISPENSER

CROSS-REFERENCE TO RELATED APPLICATION

This application claims the benefit of priority of U.S. provisional application No. 63/114,644, filed Nov. 17, 2020, the contents of which are herein incorporated by reference.

BACKGROUND OF THE INVENTION

The present invention relates to medication dispensers and, more particularly, to a medication container dispenser.

Most pill containers hold a 30-day supply. Some tray type dispensers need to be loaded by someone weekly and may have a section for morning medications and another section for evening medications. Loading these dispensers every week is time consuming and cumbersome.

PillPack®, Inc., an online pharmacy, must destroy all medications returned when a doctor changes a patient's prescription. The patient has no medications to take until the online pharmacy sends a new, corrected months' supply. They also cannot send all medications through the mail. Multiple dispensing modes leaves room for error. Failure to keep track of the medications a patient has taken results in missed dosages and/or overdoses.

As can be seen, there is a need for an easy-to-use medication dispenser that does not need to be refilled weekly.

SUMMARY OF THE INVENTION

In one aspect of the present invention, a pharmaceutical dispenser is provided, configured to accommodate a plurality of capped cylindrical pharmaceutical containers. The dispenser comprises a substantially cylindrical dispenser body including a curved sidewall having a planar longitudinal surface, a first end comprising a base perpendicular to the planar longitudinal surface, a second end, with an orifice, opposite the base, and a side portal spaced from the base, said side portal having a perimeter in an arced "T" shape with rounded edges; and a cap removably couplable to the first end and to the second end These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a dispenser that holds a plurality of stacked commercially available pharmaceutical containers suitable to contain, tablets, capsules, or caplets. By stacking the containers on top of one another within the dispenser, a first one on the bottom and a last one on the top, it is easy to see if a patient has taken the first medication.

After loading up to 6 containers, a first pharmaceutical container rests in the bottom slot. In the morning, the user may ingest a pill from the first pharmaceutical container and return the container to the top of the dispenser. A second pharmaceutical container then rests in the bottom slot. Once the user has taken one dose of the medications in the containers, the user is good to go for another 29 days without missed dosages or overdoses.

The inventive dispenser makes it easy to travel with your medications in one safe place. For traveling, the user may slide the top cap on the tracks and fit the dispenser into most carry-on luggage. The top cap may be stored on the base of the dispenser when the dispenser is in use. The top cap has a planar surface with a cap rim corresponding to a curved sidewall of the dispenser, The rim has grip protrusions on an outer surface and tabs on an inner surface. The tabs latch into notches on the surface of the dispenser wall adjacent to the open end or to the base. The planar surface has a recessed region that allows the user to insert a fingertip to urge the top cap off the dispenser.

The dispenser may be mounted to a surface by a variety of mounting means selected from the group consisting of mounting hardware such as screws, hook and loop attachments, suction cups, and combinations thereof.

The materials of manufacture are not particularly limited. For example, the dispenser may be manufactured of a rigid plastic by an Injection molding process.

Figure 1:
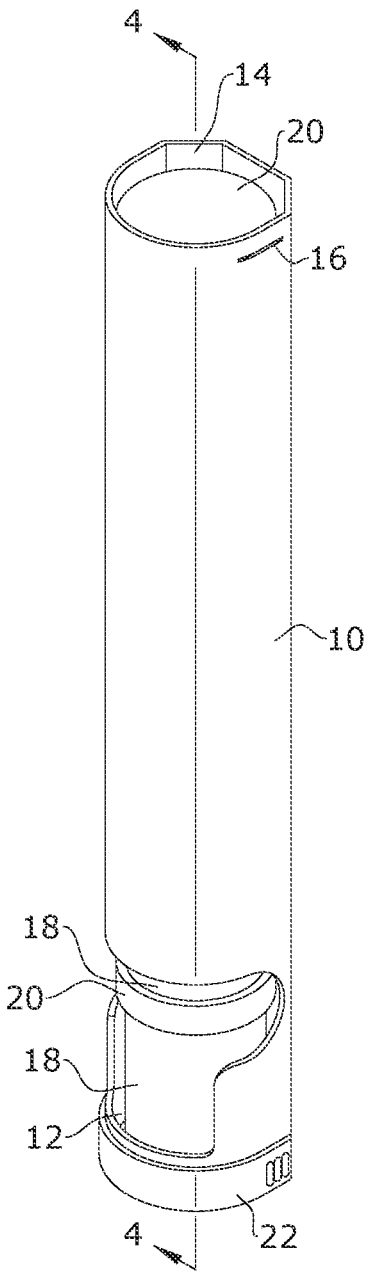
FIG. 1 is a perspective view of a pill container dispenser according to an embodiment of the present invention.
Figure 2:
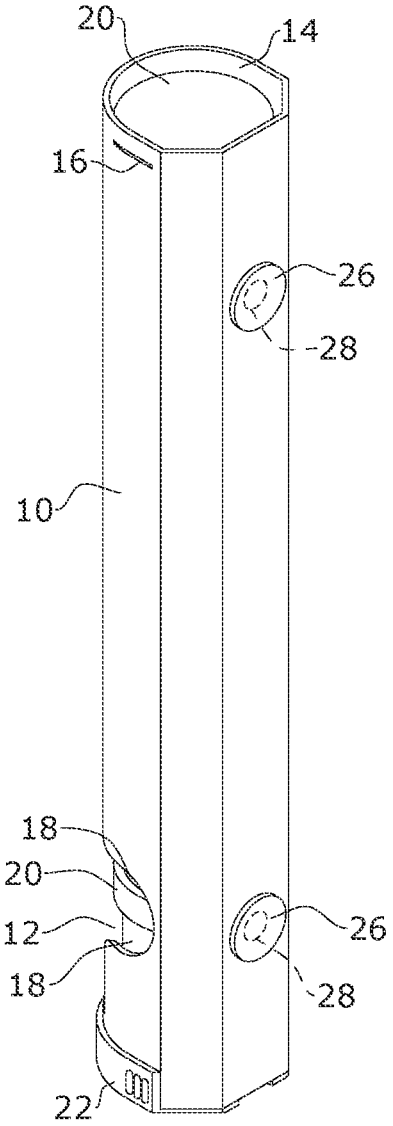
FIG. 2 is another perspective view thereof.
Figure 3:
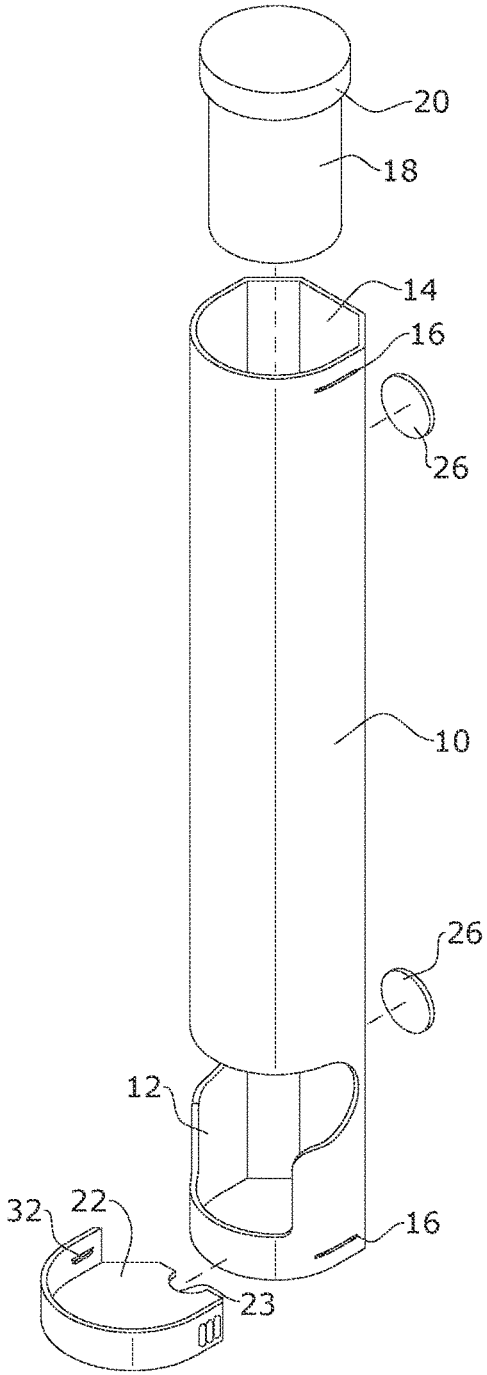
FIG. 3 is an exploded view thereof.
Figure 4:
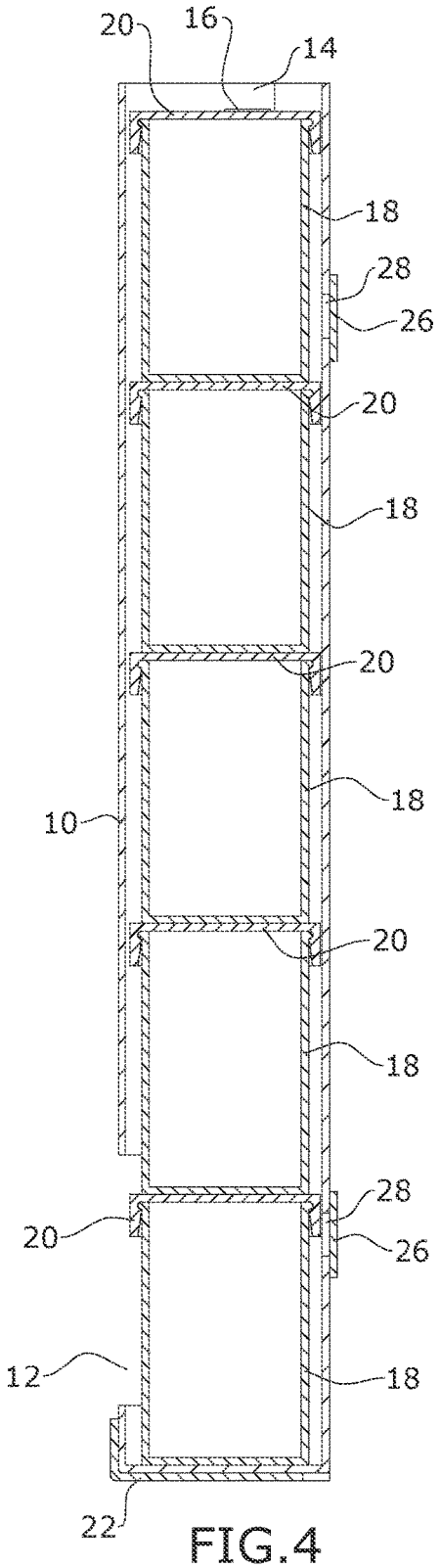
FIG. 4 is a sectional view thereof, taken along line 4-4 in FIG. 1.
Figure 5:
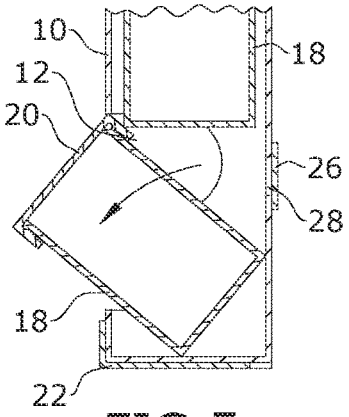
FIG. 5 is a detail sectional view thereof, showing the dispenser in use.
Figure 6:
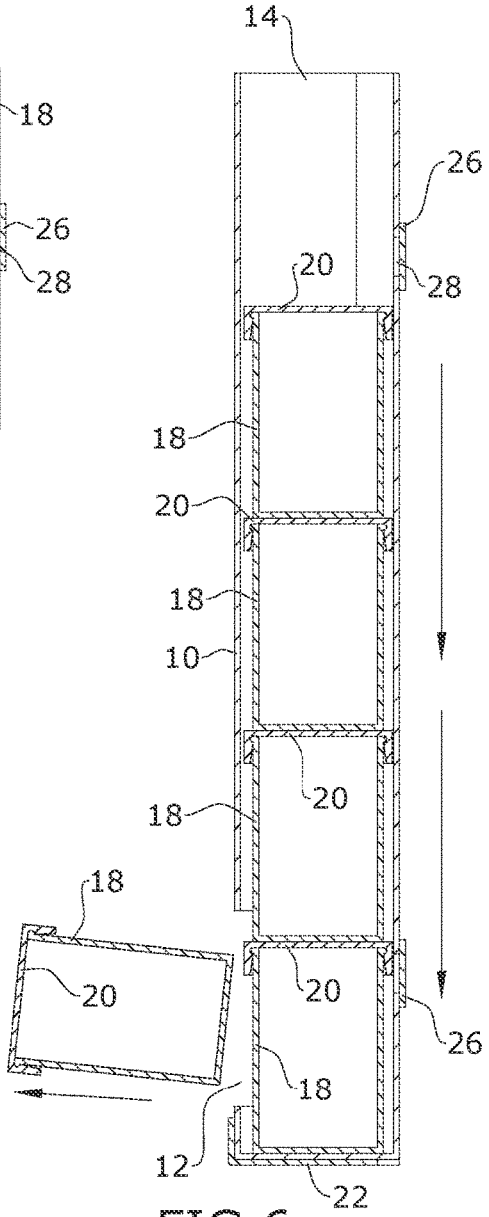
FIG. 6 is another sectional view thereof, showing the dispenser in use.
Figure 7:
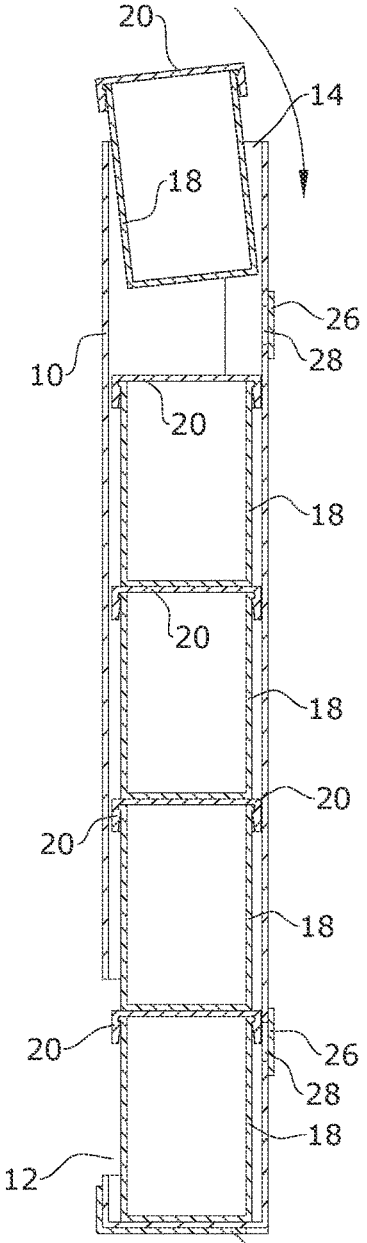
FIG. 7 is another sectional view thereof, showing the dispenser in use.
Figure 8:
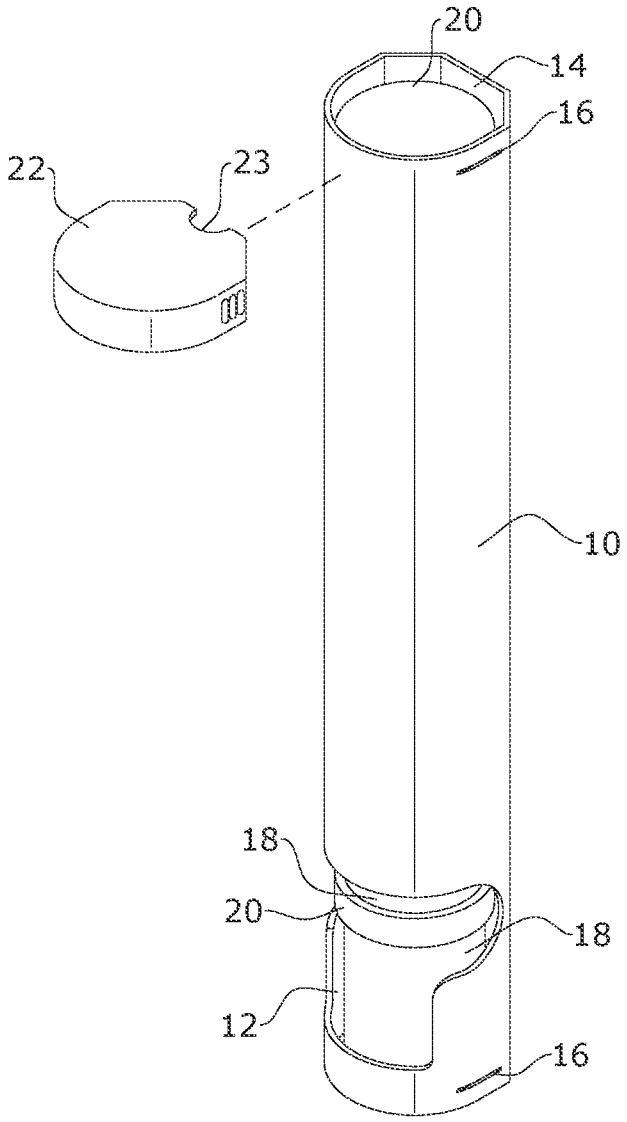
FIG. 8 is an exploded view thereof, shown in a travel configuration.
Figure 9:
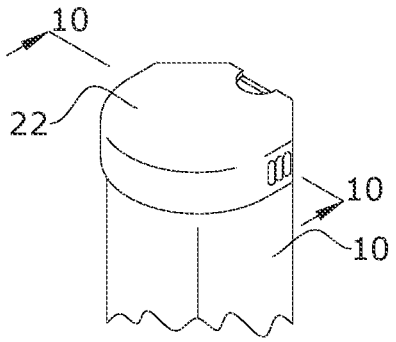
FIG. 9 is a perspective view thereof.
Figure 10:
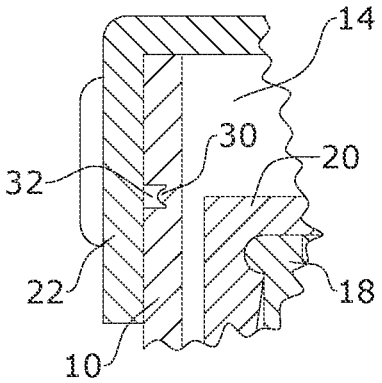
FIG. 10 is a detail sectional view thereof, taken along line 10-10 in FIG. 9.

Referring to FIGS. 1 through 10, a dispenser body 10 according to an embodiment of the present invention is shown in FIG. 1 with a container opening 12 and a top opening 14 holds up to 6 pill containers 18, each pill container 18 having a pill container lid 20. The container opening 12 is formed in a curved sidewall of the dispenser body 10. As shown in FIG. 2, a planar longitudinal surface opposite the container opening 12 has hook and loop attachments 26 and screw holes 28 for mounting the dispenser, such as to a wall or to a vanity mirror. The planar longitudinal surface is joined with the curved sidewall by a pair of ancillary planar longitudinal surfaces which extend from each edge of the planar longitudinal surface at obtuse angles. The dispenser body 10 has cap holding notches 16 at both ends with cap holding detents 30 therein which reversibly couple with cap locking tabs 32 of a travel top opening cap 22. The travel top opening cap 22 has a recessed region 23 that allows a user to insert a fingertip to urge the cap 22 off the dispenser body 10. The travel top opening cap 22 may be stored on the base of the dispenser body 10 when not in use. In some cases, the dispenser body 10 may have two caps 22, one on each end. FIGS. 5, 6, and 7 demonstrate how the dispenser body 10 may be used by removing a pill container

18 from the container opening 12 and reinserted into the top opening 14 once the patient has taken the medication dose. The container opening 12 or slot has an arced "T" shape with rounded corners which enables easy removal of the bottom container 18, as the user's fingers have access to the sides of the container 18.

It should be understood, of course, that the foregoing relates to exemplary embodiments of the invention and that modifications may be made without departing from the spirit and scope of the invention as set forth in the following claims.

What is claimed is:

1. A pharmaceutical dispenser configured to accommodate a plurality of capped cylindrical pharmaceutical containers, comprising:

a substantially cylindrical dispenser body including:

a curved sidewall having a planar longitudinal surface and notches formed in the curved sidewall, a first end comprising a base perpendicular to the planar longitudinal surface, a second end, with an orifice, opposite the base, and a side portal spaced from the base, said side portal having a perimeter in an arced "T" shape with rounded edges; and a cap removably couplable to the first end or to the second end; wherein the cap is operative to couple to the first end in a use position; and wherein the cap has a curved cap rim, operative to abut the curved sidewall when coupled to the first end or to the second end, having locking tabs formed on an inner surface thereof, and wherein the cap is operative to couple to the second end in a storage position;

wherein the notches are adjacent to the first and the second end and wherein said notches are adapted to receive the locking tabs.

2. The pharmaceutical dispenser of claim 1, wherein the planar longitudinal surface is joined to the curved sidewall by ancillary planar longitudinal surfaces extending from the planar longitudinal surface at an obtuse angle.

3. The pharmaceutical dispenser of claim 1, wherein the planar longitudinal surface further comprises mounting means selected from the group consisting of: apertures configured to accommodate mounting hardware, hook and loop attachments, suction cups, and combinations thereof.

4. The pharmaceutical dispenser of claim 1, wherein the cap has a recessed region, configured to accommodate a fingertip, in an edge of the cap adjacent to the planar longitudinal surface when the cap is coupled to the first end or to the second end.

5. The pharmaceutical dispenser of claim 1, further comprising grip protrusions on an outer surface of the curved cap rim at locations aligned with the locking tabs.

* * * * *